US006294515B1

(12) United States Patent
Baum

(10) Patent No.: US 6,294,515 B1
(45) Date of Patent: Sep. 25, 2001

(54) LOW FOAMING RINSE AGENTS COMPRISING ALKYLENE OXIDE MODIFIED SORBITOL FATTY ACID ESTER AND DEFOAMING AGENT

(75) Inventor: Burton M. Baum, Mendota Heights, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 08/330,597

(22) Filed: Oct. 28, 1994

Related U.S. Application Data

(63) Continuation of application No. 08/050,531, filed on Apr. 20, 1993, now abandoned.

(51) Int. Cl.[7] ..... C11D 7/02
(52) U.S. Cl. ..... 510/514; 510/513
(58) Field of Search ..... 510/514, 513, 510/535

(56) References Cited

U.S. PATENT DOCUMENTS

| | | | | |
|---|---|---|---|---|
| 4,104,054 | * | 8/1978 | Beck | 71/103 |
| 4,793,943 | * | 12/1988 | Haslop et al. | 252/135 |
| 4,797,273 | * | 1/1989 | Linn et al. | 425/59 |
| 4,824,593 | * | 4/1989 | Appel et al. | 252/127 |
| 4,871,467 | * | 10/1989 | Akred | 252/135 |
| 5,055,325 | * | 10/1991 | Trivett | 427/388.1 |
| 5,133,892 | * | 7/1992 | Chun et al. | 252/90 |
| 5,160,448 | * | 11/1992 | Corring | 252/95 |

FOREIGN PATENT DOCUMENTS

| | | | |
|---|---|---|---|
| 0008830 | * | 3/1980 | (EP) . |
| 51-68608 | * | 6/1976 | (JP) . |
| 2288697 | * | 6/1986 | (JP) . |
| 62288697 | * | 12/1987 | (JP) . |
| 0226680 | * | 6/1990 | (JP) . |

OTHER PUBLICATIONS

CA 108(18): 152593g Dec. 15, 1987.*

* cited by examiner

*Primary Examiner*—Alexander G. Ghyka
(74) *Attorney, Agent, or Firm*—Merchant & Gould P.C.

(57) ABSTRACT

Nonionic surfactants comprising a mixture of fatty acid esters of sorbitol and sorbitol anhydrides comprising predominantly the mono, di- or tri ester condensed with approximately 15 or more moles of an alkylene oxide in combination with an effective defoamer and a water soluble diluent form surprisingly useful and effective low foaming rinse agent composition or concentrate. The rinse agent can achieve adequate sheeting in common aqueous rinses at typical rinse temperatures at a concentration of the nonionic sorbitan ester in water at concentrations about 500 parts of the fully formulated rise agent per million parts of water. The rinse agents can be used in a rinse cycle in common warewashing machines after washing with commonly available warewashing compositions. The rinse agents can take the form of thickened pourable or semi-pourable aqueous liquids or cast solid materials packaged within a disposable wrapper, capsule or other package. The preferred form of the rinse agent is a pourable or pumpable aqueous concentrate. The uniqueness of the invention relates to the fact that all components are not expected to be active as sheeting agents and are approved as food additives thereby eliminating any health concerns associated with residual deposits of the composition on cleaned ware.

25 Claims, No Drawings

LOW FOAMING RINSE AGENTS COMPRISING ALKYLENE OXIDE MODIFIED SORBITOL FATTY ACID ESTER AND DEFOAMING AGENT

This is a continuation, of application Ser. No. 08/050,531 filed Apr. 20, 1993 , which was abandoned upon the filing hereof.

Field of the Invention

The invention relates to warewashing processes and chemicals used in washing and rinsing kitchen and table ware, including dishware and flatware. More particularly, the invention relates to primarily organic materials in the form of a rinse agent concentrate that can be added to an aqueous diluent to form an aqueous rinse composition promoting sheeting action in a rinse cycle after an alkaline detergent cycle. Such an aqueous rinse agent can provide effective sheeting resulting in the removal of aqueous materials from dishware and flatware and must be low foaming and nontoxic. A decidedly added benefit of the rinse aid is the use of materials that are approved as additives to food. These materials are listed in the Code of Federal Regulations as direct food additives or as GRAS (Generally Recognized as Safe).

BACKGROUND OF THE INVENTION

Mechanical warewashing machines have been common in institutional and household environments through the years. Such mechanical automatic warewashing machines are designed to operate with two or more cycles which include initially a wash cycle followed by a rinse cycle. Such dishwashers can also utilize a soak cycle, a prewash cycle, a main wash cycle, a rinse cycle, a sanitizing cycle and a drying cycle if required. Such cycles can be repeated and additionally cycles such as a scraping cycle, i.e., a rinse cycle before a wash cycle can be used, etc. After passing through a wash cycle, flatware, dishware, kitchen ware, cups, glasses, knives, forks, spoons, etc. can exhibit spotting that arises from the uneven draining of the water from the surface of the ware after the rinse step. Spotting is aesthetically unacceptable in most consumer and institutional environments.

In order to substantially prevent the formation of such spotting, rinse agents have been commonly added to an aqueous diluent to form an aqueous rinse used in a rinse cycle. The precise mechanism through which rinse agents work is not well established. One theory holds that the surfactant in the rinse aid is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and, according to this theory, would not promote sheet formation, thereby resulting in spots. Moreover, high foaming materials are known to interfere with the operation of the warewashing machine.

Rinse additives are well known to the trade and have been in use for thirty or more years. However, there is an unmet need for rinse additives which are made entirely of food additive materials; this is a very challenging situation since it greatly limits what can be used in the formulation; it is also a very unique situation in that few combinations will work that meet the food additive criteria. Common rinse additive formulas are used in amounts of less than about 1000 parts of the rinse aid or active sheeting agent per million parts of the aqueous rinse. Rinse aids available in the consumer and institutional markets comprise liquid, thickened semi-liquid or solid forms which are typically added to or dispersed or dissolved in aqueous diluents to form an aqueous rinse prior to use. Such dissolution or dilution can occur from a rinse agent installed onto the dish rack or can be dispensed from a dispenser integral with the machine or from a separate dispenser that is cooperatively mounted near or onto the exterior of the dish machine. Many commonly available active ingredients for rinse agents are made of polyalkylene oxide substituted materials preferably ethylene oxides/propylene oxide block copolymers.

A substantial need has arisen to obtain rinse compositions comprised solely of food additive ingredients. We have discovered that a class of nonionic surfactants, namely, the polyalkylene oxide derivatives of sorbitan fatty acid esters have surprising levels of sheeting action and can be formulated into effective rinse agents with a careful selection of defoamer compositions. We have found that these nonionic sorbitan based surfactants can be effectively defoamed with materials approved as food additives. We have found that these defoamers are compatible with sorbitan materials in the rinse agents and the agents can be combined with an aqueous diluent to form an effective aqueous rinse. The rinse agent of the invention is preferably a liquid that can be metered or diluted into an aqueous rinse stream in controlled proportions.

Haslop et al., U.S. Pat. No. 4,618,446, teaches a variety of ingredients for use in spherical liquid detergent compositions.

Haslop et al., U.S. Pat. No. 4,793,943, teaches a variety of ingredients useful for making liquid detergent compositions.

Akred et al., U.S. Pat. No. 4,871,467, teaches a variety of compositions and materials used to form non sedimenting liquid detergent compositions.

Aronson et al., U.S. Pat. No. 5,045,225, teaches a combination of hydrocarbon oils and silicone compositions as antifoam materials.

Gentle et al., U.S. Pat. No. 5,073,298, teaches silicone silicate based defoaming compositions.

Chun et al., U.S. Pat. No. 5,133,892, teaches machine dishwashing detergent tablets having timed release of enzyme and chlorine bleach and a variety of other ingredients used in making the detergent composition.

Tsukada, Japanese Patent Application Publication Kokai 49-126,703, teaches carbohydrate aliphatic ester rinse agents.

Miura et al., Japanese Patent Application Publication Kokai 50-62,211, teaches polyhydric alcohol containing rinse agents.

Miura et al., Japanese Patent Application Publication Kokai 51-68,608, teaches polyol aliphatic ester containing rinse agent compositions. Suzuki et al., Japanese Patent Application No. 86-31,272, teaches a rinse agent comprising a polyethoxylated sorbitan fatty acid ester glycerol and a sugar alcohol.

Suzuki et al., Japanese Patent Application No. 86-161, 193, teaches a similar material.

Nantaku, Japanese Patent Application No. 59-187,096, teaches a polyglycerine ester of a $C_{6-8}$ fatty acid containing rinse agent.

Wilson et al., "Rinse Additives for Machine Dishwashing", *Soap and Chemical Specialties*, pp 48 et seq.

(February 1958), discussed the basic technology regarding rinse agent formulation.

None of the prior art recognize the sheeting action of the nonionics of the invention nor combine the preferred high cloud point, high foaming surfactants with appropriate defoamers to achieve a rinse agent that can be diluted into an aqueous rinse providing low foaming sheeting properties.

BRIEF DESCRIPTION OF THE INVENTION

The invention is a concentrated effective low foaming rinse agent composition formulated from components approved as food additives which comprise a combination of a polyalkylene oxide derivative of a mono-, di- or tri-fatty acid ester sorbitan or sorbitol composition with an effective defoamer. We have found that the effective defoamer compositions of the invention are selected from the group consisting of a silicone defoamer, an alkali metal (e.g. sodium, potassium, etc.) or alkaline earth fatty acid salt defoamer or a glycerol fatty acid mono ester defoamer. Preferably, silicone based materials are used to defoam the sorbitan material. We have found that this composition provides dependable high levels of sheeting action with little or no foam production.

For the purposes of this invention, the term "aqueous rinse" is directed to aqueous compositions containing concentrations, typically less than 1000 ppm of active sheeting agent materials and compatible defoamers and other additives, that are directly applied to the dishware to obtain rinsing. The term "sheeting agent" refers to the individual component or components of the rinse agent that causes the aqueous rinse to sheet. The term "rinse agent" reflects the concentrate material which is diluted with an aqueous diluent to form the aqueous rinse. The term "ware", "table ware", "kitchen ware" or "dishware" refers to various types of articles used in the preparation, serving and consumption of foodstuffs including pots, pans, baking dishes, processing equipment, trays, pitchers, bowls, plates, saucers, cups, glasses, forks, knives, spoons, spatulas, grills, griddles, burners, and the like. The term "rinsing" or "sheeting" relates to the capacity of the aqueous rinse when in contact with ware to form substantially continuous thin sheets of the aqueous rinse which drain evenly from the ware leaving little or no spotting upon evaporation of the water. In our research on developing rinse agents, in sharp contrast with the belief in the art, we found that the sorbitan esters are surprisingly good sheeting agents even though they have high cloud points and generate significant volumes of foam in use. Those skilled in the art find that surfactants in rinse aids require both effective wetting agent properties and low foaming properties. Traditionally, rinse agents have been formulated to contain only nonionic surfactants with relatively low cloud points since these materials exhibit little foam above the cloud point. The sorbitan esters of the invention have cloud points above 100° C. and were consistently considered to be poor candidates for rinse agents because high cloud points indicate poor sheeting properties. However, we have found surprisingly that although these materials foam significantly, they have acceptable sheeting properties at approximately 200 parts, preferably 100 parts, of the nonionic ester per million parts of rinse composition. Moreover, we have found that the use of certain classes of defoamers in combination with the nonionic sorbitan esters of the invention surprisingly yield rinse agent materials with very low foaming properties that perform very well in sheeting tests. We have found food additive defoamers that can be combined with food additive sorbitan materials. Most high foaming nonionic materials are generally hydrophilic and quite water soluble. On the other hand, adequate defoaming materials tend to be quite hydrophobic. Hydrophilic and hydrophobic materials are generally incompatible at high concentrations in a concentrated form. In many warewashing apparatus, defoaming materials are often added directly to rinse aid or other aqueous compositions at the point of use. The defoamer not only suppresses the foam of the high cloud point nonionic material, but appears to make the nonionic behave like the low cloud point material in forming an evenly draining continuous film. This property of the combination is unexpected.

For the purposes of this application, the term "food additive" means materials listed in the U.S. Code of Federal Regulations 21 Part 172—Food Additives Permitted for Direct Addition to Food for Human Consumption, 21 Part 182—Substance Generally Recognized as Safe and 21 Part 184—Direct Food Substances Affirmed as Generally Recognized as Safe, and 21 Part 173—Secondary Direct Food Additives Permitted in Food for Human Consumption, Section 173.310—Defoaming Agents.

DETAILED DESCRIPTION OF THE INVENTION

The invention relates to a liquid rinsing composition effective at a concentration of about 20 to 200 parts of the active nonionic surfactant material in an aqueous rinse for preventing spotting and streaking commonly associated with the machine washing of ware. Broadly, the rinse aid composition includes a polyalkylene oxide derivative of a sorbitan or sorbitol aliphatic ester, and an effective defoamer for the sorbitan or sorbitol composition. The rinse aid composition is typically formulated in a liquid diluent compatible with the rinse agent in the final aqueous rinse composition. The uniqueness of the invention relates to the fact that the active components are not expected to be active as sheeting agents and are approved as food additives thereby eliminating any health concerns associated with residual deposits of the composition on cleaned ware. Sorbitol, also known as d-glucitol, having the formula:

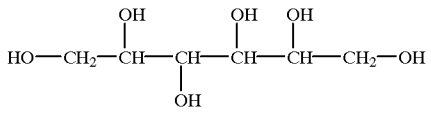

is a polyhydroxy compound. Sorbitol often takes the form of one of these cyclic anhydrides each often known as a sorbitan; it may also take the form of hexahydric cyclic five- or six-membered rings or of a fused system containing two five-membered rings as shown below:

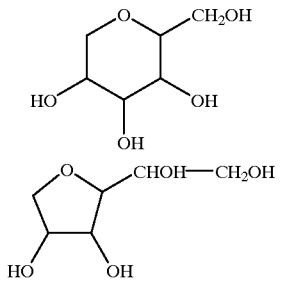

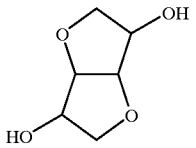

Sorbitol and sorbitan can be derivatized with an alkylene oxide such as ethylene oxide or propylene oxide or derivatized with fatty acids or with both using conventional technology to produce nonionic surfactant sheeting agent materials. These sheeting agents are typically characterized by the presence of from 1 to 3 moles of a fatty acid, in ester form, per mole of surfactant and greater than 15 moles of alkylene oxide, preferably 15 to 40 moles of alkylene oxide and most preferably 15 to 25 moles of ethylene oxide per mole of surfactant. The composition of the surfactant is a mixture of a large number of compounds characterized by the molar proportion of alkylene oxide and the molar proportion of fatty acid residues on the sorbitol or sorbitan molecules. The compositions are typically characterized by average concentrations of the alkylene oxide (typically ethylene oxide) and the fatty acid on the overall compositions. Examples of preferred nonionic surfactants are Polysorbate 20®, also known as Tween 20® (ICI), typically considered to be a mixture of laurate esters of sorbitol and sorbitan consisting predominantly of he mono fatty acid ester condensed with approximately 20 moles of ethylene oxide. Polysorbate 60® is a mixture of stearate esters of sorbitol and sorbitan consisting predominantly of the mono fatty acid ester condensed with approximately 20 moles of ethylene oxide. Tween 80® (ICI) is a mixture of oleate esters of sorbitol and sorbitan consisting predominantly of the mono fatty acid ester condensed with approximately 20 moles of ethylene oxide. Selected polysorbate nonionic surfactant materials are approved for direct use in food intended for human consumption under specified conditions and levels of use.

Alkoxylated sorbitan or sorbitol aliphatic esters suitable for use in the rinse aid composition of the invention include any sorbitan or sorbitol aliphatic ester derivatized with an alkylene oxide capable of providing effective sheeting action or rinsing performance in cooperation with the other components of the rinse agent composition. The preferred composition for use in the invention are the ethylene oxide condensates with sorbitan or sorbitol fatty acid esters. In addition to providing superior sheeting and rinsing performance, these materials are approved food additives, in the form of a liquid or waxy solid, that can be easily formulated into concentrated liquid or solid rinse agents. Alkoxylated sorbitan or sorbitol fatty acid esters suitable for use in the rinse agent of the invention include mono, di and tri esters and mixtures thereof. Sorbitan fatty acid esters may be derivatized by esterification of sorbitol or sorbitan with such fatty acids as lauric, myristic, palmitic, stearic, oleic, linoleic, and other well known similar saturated, unsaturated (cis or trans), branched and unbranched fatty acid. Preferred food additive or GRAS fatty acids are the sorbitan esters approved as direct food additive (e.g. sorbitan monostearate, PoE 20 Sorbitan monolaurate, PoE 20 Sorbitan monostearate, PoE 20 Sorbitan monooleate and mixtures thereof. Based on their cost availability and ability to provide excellent sheeting action and rinsing performance, the preferred useful ethoxylated sorbitan or sorbitol fatty acid ester include mono esters derivatized with ethylene oxide.

Defoaming agents useful in this invention include a variety of different materials adapted for defoaming aqueous compositions. Defoamers can comprise an anionic and nonionic surfactant, fatty acids and fatty acid derivatives, phosphate esters, sulfonated materials, silicone based compositions, polyethylene glycol, polypropylene glycol, fatty acid sulfates and others. Preferred defoamers comprise defoamers approved as food additives including silicones. Silicone foam suppressors include polydialkylsiloxane preferably polydimethylsiloxane. Such silicone based foam suppressors can be combined with silica. Such silica materials can include silica, derivatized silica, silanated silica, etc. Commonly available antifoaming agents combines a polydimethylsiloxane and silica gel. Another preferred food grade defoaming agent comprises a fatty acid containing defoamer. Such defoamer compositions can comprise simple alkali metal or alkaline earth metal salts of a common fatty acid or mixtures of fatty acids or fatty acid compounds. Additionally, fatty acid derivatives can also be used as defoamers. Examples of such derivatives include mono, di- and tri-fatty acid esters of polyhydroxy compounds such as ethylene glycol, propylene glycol, glycerine, hexylene glycol, etc. Preferably such defoaming agents comprise a fatty acid monoester of glycerol. Fatty acids useful in such defoaming compositions can include any $C_{8-24}$ fatty acid, including for example myristic acid, palmitic acid, stearic acid, arachidic acid, behenic acid, lignoceric acid, cerotic acid, palmitoleic acid, vaccenic acid, linoleic acid, arachidonic acid, and others commonly available. Other anti-foam agents available, that are approved as additives in food include water-insoluble purified waxes, preferably a microcrystalline wax having a melting point in the range from about 35° to 125° C. with a low saponification value, hydrocarbon white oil and others. Such materials are used in the rinse agents of the invention at a sufficient concentration to prevent the accumulation of any measurable stable foam within the dish machine during a rinse cycle.

The food grade rinse aid composition of the invention can contain one or more solid water soluble food additive fillers for the purpose of facilitating processing or dispensing of the composition or contributing to other performance characteristics. Many different types of fillers may be utilized in the rinse agent composition, including such compounds as a sugar, such as glucose, fructose, sucrose; an alkali metal salt such as sodium chloride, potassium chloride, sodium carbonates, sodium bicarbonate, sodium sulfate, potassium sulfate, sodium acetate, sodium lactate, water soluble amino acids such as alanine, arginine, glycine, lysine, proline; polyphosphates such as alkali metal tetrasodium pyrophosphate, a sodium phosphate and others.

The rinse agents of the invention can contain a polyvalent metal complexing or chelating agent that aids in reducing the harmful effects of hardness components in service water. Typically calcium, magnesium, iron, manganese, etc., ions present in service water can interfere with the action of either washing compositions or rinsing compositions. A chelating agent can effectively complex and remove such ions from inappropriate interaction with active ingredients increasing rinse agent performance. Both organic and inorganic chelating agents are common. Inorganic chelating agents include such compounds as sodium tripolyphosphate and higher linear and cyclic polyphosphate species. Organic chelating agents include both polymeric and small molecule chelating agents. Polymeric chelating agents commonly comprise polyanionic compositions such as polyacrylic acids compounds. Small molecule organic chelating agents include salts of ethylenediaminetetracetic acid and hydroxyethylenediaminetetracetic acid, nitrilotriacetic acid, ethylenediaminetetrapropionates, triethylenetetraminehexacetates, and the respective alkali metal ammonium and substituted ammonium salts thereof. Amino phosphates are also suitable for use as chelating agents in the composition of the invention and include ethylenediamine(tetramethylene phosphonates), nitrilotrismethylenephosphonates, diethylenetriamine (pentamethylenephosphonates). These amino phosphonates commonly contain alkyl or alkyl groups with less than 8 carbon atoms. Preferred chelating agents for this invention include approved food additive chelating agents such as disodium salt of ethylenediaminetetracetic acid.

The liquid rinse agent compositions of the invention have a liquid base component which can function as a carrier with various aqueous diluents to form the aqueous rinse. Liquid bases are preferably water or a solvent compatible with water to obtain compatible mixtures thereof. Exemplary nonlimiting solvents in addition to water include low molecular weight $C_{1-6}$ primary and secondary mono, di, and trihydrate alcohol such as ethanol, isopropanol, and polyols containing from two to six carbon atoms and from two to six hydroxyl groups such as propylene glycol, glycerine, 1,3-propane diol, propylene glycol, etc.

The compositions of the invention can be formulated using conventional formulating equipment and techniques. The compositions of the invention typically can comprise proportions as set forth in Table I.

In the manufacture of the liquid rinse agent of the invention, typically the materials are manufactured in commonly available mixing equipment by charging to a mixing chamber the liquid diluent or a substantial proportion of a liquid diluent. Into a liquid diluent is added preservatives or other stabilizers. Care must be taken in agitating the rinse agent as the formulation is completed to avoid degradation of polymer molecular weight or exposure of the composition to elevated temperatures. The materials are typically agitated until uniform and then packaged in commonly available packaging and sent to storage before distribution.

TABLE I

Liquid Rinse Agent Proportions (wt %)

| | Useful | Preferred | Most Preferred |
|---|---|---|---|
| Nonionic Sheeting Agent | 0.1–50 | 5–40 | 10–30 |
| Defoamer | 0.1–30 | 0.2–25 | 1–15 |
| Thickener | 0–5 | 0–4 | 0.1–1 |
| Preservative | 0.0–1 | 0.01–0.5 | 0.025–0.2 |
| Diluent | Bal. | Bal. | Bal. (89 or more) |

The liquid materials of the invention can be adapted to a cast solid format by incorporating into the composition a casting agent. Typically organic and inorganic solidifying materials can be used to render the composition solid. Preferably organic materials are used because inorganic compositions tend to promote spotting in a rinse cycle. The most preferred casting agents are polyethylene glycol and an inclusion complex comprising urea and a nonionic polyethylene or polypropylene oxide polymer. Polyethylene glycols (PEG) are used in melt type solidification processing by uniformly blending the sheeting agent and other components with PEG at a temperature above the melting point of the PEG and cooling the uniform mixture. An inclusion complex solidifying scheme is set forth in Morganson et al., U.S. Pat. No. 4,647,258.

The solid compositions of the invention are set forth n Table II as follows:

TABLE II

Solid Rinse Agent Proportions (wt %)

| | Useful | Preferred | Most Preferred |
|---|---|---|---|
| Nonionic Sheeting Agent | 1–50 | 5–40 | 10–30 |
| Defoamer | 0.1–30 | 0.2–25 | 1–15 |
| Thickener | 0–5 | 0–4 | 0–1 |
| Preservative | 0.001–1 | 0.01–0.5 | 0.025–0.2 |
| Solidifying Agent | 0–25 | 0.1–15 | 0.5–10 |
| Diluent | Bal. | Bal. | Bal. |

The organic nature of the rinse agents of the invention can be subject to decomposition and microbial attack. Preferred stabilizers that can limit oxidative decomposition or microbial attack include food grade stabilizers, food grade antioxidants, etc. Most preferred materials for use in stabilizing the compositions of the invention include $C_{1-10}$ mono, di- and tricarboxylic acid compounds. Preferred examples of such acids include acetic acid, citric acid, lactic, tartaric, malic, fumaric, sorbic, benzoic, etc.

Optional ingredients which can be included in the rinse agents of the invention in conventional levels for use include solvents, hydrotropes, processing aids, corrosion inhibitors, dyes, fillers, optical brighteners, germicides, pH adjusting agents (monoethanol amine, sodium carbonate, sodium hydroxide, hydrochloride acid, phosphoric acid, et cetera), bleaches, bleach activators, perfumes and the like.

TABLE III

RINSE AGENT CONCENTRATE CONTAINING PREFERRED DEFOAMERS-FORMULATIONS (wt-%)

| | Useful | Preferred | Most Preferred |
|---|---|---|---|
| Sorbitan Ester Nonionic Agent | 1–50 | 5–40 | 10–30 |
| Generic Defoamer | 0.1–30 | — | — |
| Fatty Acid Salt Defoamer | — | 0.5–15 | 0.75–10 |
| Fatty Acid Glyceryl Ester Defoamer | — | 0.5–15 | 0.75–15 |
| Silicone Defoamer | — | 0.5–15 | 0.75–10 |
| Preservative | 0.001–1 | 0.01–0.5 | 0.025–0.2 |
| Filler | 0.01–25 | 0.01–20 | 0.5–15 |
| Thickener | 0–5 | 0–4 | 0.1–1 |
| Anti-Oxidant | 0.01–25 | 0.01–20 | 0.5–15 |

The above discussion provides a general understanding of the compositions and use of the invention. The following examples and data provide further explanation of specific embodiments of the invention and disclose the best mode.

WORKING EXAMPLES

Example 1

Into a suitably sized glass beaker equipped with a mechanical stirring mechanism is placed the nonionic sorbitan ester surface active agent. The material is preheated to about 120° F. Into the preheated surfactant is slowly added preheated water. The mixture is agitated until uniform and into the stirred liquid is placed additional components. Using this general preparative scheme, the compositions of the following table IV were prepared.

The sheeting test data presented in the following Tables was obtained using a Champion 1-KAB machine dishwasher having wash and rinse temperatures of about 160° F., equipped with a glass door to permit visual observation of the test pieces. For the evaluation, the test pieces were washed in soft water three times on automatic cycle using 200 grams of an alkaline detergent prepared by blending 30 wt-% sodium metasilicate, 35% sodium tripolyphosphate, 3 wt-% Plurafac® surfactant No. RA-43, and 32% sodium carbonate. During the three wash cycles no rinse additive was used. To determine the sheeting effect, the machine was filled with water and set on manual. Into the water was added 2000 parts of a 2:1 mixture of margarine and non-fat milk per million parts of rinse water, and a minimum measured amount of the tested rinse composition. The mixture was circulated for 3 minutes and the concentration of rinse additive was progressively increased by injecting increasing amounts of rinse composition until a substantially continuous sheeting effect of the rinse water was noted over substantially all the test pieces. The minimum concentration for continuous sheeting was noted and recorded in Table V.

The data recorded in the following Tables entitled Dynamic Foam Test was generated in a foam test device which is a cylindrical container 8 liters in volume, 15 centimeters in diameter and 50 centimeters in height equipped with an electric hot plate for temperature control, and a pump to recirculate the test solution at 6 psi via a means to direct a spray of the test solution onto the surface of the contents of the solution to generate foam. The rinse aid formulations were added to the water at 160° F. to give a concentration of 100 ppm of sheeting agent. The foam heights were determined after 1 and 5 minutes of circulation. The persistence or stability of the foam was also noted. An unstable foam designated by the letter U, collapsed when the pumping was stopped. Foam heights less than 3" inches and unstable foam production are preferred.

TABLE IV

Using the preparation as shown in Example 1, a series of rinse aids were prepared as shown in the Table IV.
Food Grade Rinse Aids

| FORMULAS | A | B |
|---|---|---|
| Tween 80* | 20.0 | 20.0 |
| Na Oleate | 1.0 | 2.0 |
| $H_2O$ (Dist.) | 79.0 | 78.0 |
| 100% pH | 7.8 | 8.2 |
| Appearance When Made | Clear Light Amber | Clear Light Amber |

*Commonly known as a polysorbate; number refers to the ester, 60 is stearate, 20 is laurate and 80 is oleate; a Tween 60 or 65 material is a stearic acid ester of sorbitan. The Tween 80 material is an oleic acid ester. Note: Tween is a trademark of ICI.

TABLE V

High Temperature Rinse Additive Sheeting Test

Product: Example 1A Clear Light Amber Liquid

Tween 80 20%
Na Oleate 1%
Water Bal.

Conditions:
Champion 1KAB Machine
City Water

Key:
— No Sheeting
P Pinhole Sheeting
C Complete Sheeting

| PPM* | TEMP | CHINA PLATE | MELAMINE PLATE | GLASS TUMBLER | GLASS SLIDE | S.S. KNIFE | S.S. SLIDE | FOAM INCHES |
|---|---|---|---|---|---|---|---|---|
| 0 | 162° | — | — | — | — | — | — | — |
| 25 | 162° | — | — | — | — | — | — | ½ |
| 50 | 162° | — | C | — | — | — | C | ½ |
| 75 | 161° | C | C | P | P | P | C | ½ |
| 100 | 162° | C | C | P | P | P | C | ½ |

*Active surfactant concentration
Key: S.S. = Stainless Steel
Sheeting level is concentration yielding pinhole or complete sheeting on all substrates.
— No sheeting: denotes lack of uniform film of rinse solution on rinsed surface. This results in spotting and long drying tines.
P Pinhole sheeting: denotes very thin film, in fact so thin that as evaporation of water commences the film breaks up causing a pinhole appearance.
C Complete sheeting: denotes complete and uniform wetting of surface either pinhole or complete sheeting is desirable.

These data show the rinse agents of the invention can be used in aqueous rinses in city water to obtain reasonable sheeting levels. The use of the active materials at concentrations about 50 to 150 ppm will provide adequate sheeting in most machines.

TABLE VI

High Temperature Rinse Additive Sheeting Test

Product: Example 1B

Tween 80 20%
Na Oleate 2%

Conditions:

Key:

TABLE VI-continued

High Temperature Rinse Additive Sheeting Test

Champion 1KAB Machine
Water: Soft (8 ppm Hardness)

— No Sheeting
P Pinhole Sheeting
C Complete Sheeting

| PPM | TEMP | CHINA PLATE | MELAM PLATE | GLASS TUMB. | GLASS SLIDE | S.S. KNIFE | S.S. SLIDE | FOAM INCHES |
|---|---|---|---|---|---|---|---|---|
| 0 | 171° | — | — | — | — | — | — | — |
| 25 | 170° | — | — | — | — | — | — | Trace |
| 50 | 170° | C | C | P | P | C | C | ¼* |
| 75 | 169° | C | C | P | P | C | C | ¼* |
| 100 | 167° | C | C | P | P | C | C | ¼* |
| 200 | 166° | C | C | P | P | C | C | ¼* |
| 300 | 166° | C | C | P | P | C | C | ¼* |

These data show that sodium oleate can be used to defoam the formulation in soft water.
*Breaks Quickly to 0 inches

Example 2

Using the preparative scheme of Example 1 a rinse agent was prepared containing 200 gms. of Tween 80, and 800 gms. of distilled water.

TABLE VII

High Temperature Rinse Additive Sheeting Test

Product: Tween 80 @ 20% aqueous
Conditions:
Champion 1KAB Machine
Water: Soft

Key:
— No Sheeting
P Pinhole Sheeting
C Complete Sheeting

| PPM | TEMP | CHINA PLATE | MELAM PLATE | GLASS TUMB. | GLASS SLIDE | S.S. KNIFE | S.S. SLIDE | FOAM INCHES | FOAM STAB |
|---|---|---|---|---|---|---|---|---|---|
| 0 | 172° | — | — | — | — | — | — | — | — |
| 25 | 170° | — | — | — | — | — | — | 1 | — |
| 50 | 169° | C | C | P | P | C | C | ½ | — |
| 75 | 167° | C | C | P | P | C | C | 2 | — |
| 100 | 166° | C | C | P | P | C | C | 2-¾ | Yes |

Note: Without defoamer, very high levels of foaming occurs.

These data show the rinse agents of the invention can be used in aqueous rinses in soft water to obtain reasonable sheeting levels. The use of the active materials at concentrations about 50 to 150 ppm will provide adequate sheeting in most machines.

Example 3

Using the procedure of Example 1, the following rinse aids were prepared and tested.

TABLE VIII

| Ref: | 1 | 2 | 3 | 4 | 5 | 6 | 7 | 8 | 9 |
|---|---|---|---|---|---|---|---|---|---|
| DYNAMIC FOAM TESTS - TWEEN 80/SILICONE FORMULAS | | | | | | | | | |
| CONCENTRATION, %[a] | | | | | | | | | |
| Tween 80 | 20 | 13 | 13 | 13 | 20 | 20 | 20 | 20 | 20 |
| Sod. Oleate | — | 2 | 2 | 2 | — | — | — | — | — |
| SAG 770[d] | 2 | — | — | — | — | — | — | — | — |
| 1520 US[d] | — | 6.5 | 3.3 | 1.7 | 6.5 | 3.3 | — | — | — |
| FG-10[d] | — | — | — | — | — | — | 13.2 | 6.6 | 4.4 |
| AF[d] | — | — | — | — | — | — | — | — | — |
| Si Defoamer ppm (b) | 3 | 10 | 5 | 3 | 7 | 3 | 7 | 3 | 7 |
| FOAM HT., INCHES (STABILITY)[c] | | | | | | | | | |
| CITY WATER | | | | | | | | | |
| 1 Min. | 45(P) | 0.50(U) | 1.25(U) | 1.75(U) | 0.75(U) | 1.75(U) | 1.00(U) | 1.75(U) | 1.25(U) |
| 5 Min. | 7.0(P) | 1.25(U) | 2.00(U) | 5.00(U) | 1.00(U) | 2.75(U) | 2.00(U) | 6.50(P) | 5.00(P) |

TABLE VIII-continued

| Ref: | 1 | 2 | 3 | 4 | 5 | 6 | 7 | 8 | 9 |
|---|---|---|---|---|---|---|---|---|---|
| SOFT WATER | | | | | | | | | |
| 1 Min. | | 1.50(U) | 2.50(U) | | 0.75(U) | 1.75(U) | 1.50(U) | | 2.00(U) |
| 5 Min. | 4.00(U) | 5.00(U) | 1.50(U) | 5.50(U) | 4.75(U) | 5.50(P) | | | |

[a]Rest of formulation consists of water;
[b]Level of actives delivered at use level of 100 ppm Tween 80;
[c]160 F, 6 psi, 100 ppm Tween 80, S = stable, U = unstable, P = partially stable; and
[d]All silicone defoamers. 1520 US, FG-10 and AF are products of Dow Corning; SAG 770 is supplied by Union Carbide.

The data of Table VIII show that the nonionic surfactant material can be combined with common silicone defoamers at useful proportions. The materials are compatible and can be used as a rinse aid to prepare an aqueous rinse that can achieve adequate sheeting without substantial foaming. The data of Table VIII show that the materials can be successfully defoamed in both city and soft water.

Example 4

Using the procedure of Example 1, the following rinse aids were prepared and tested for foaming and stability.

TABLE IX

| | 1 | 2 |
|---|---|---|
| Tween 80 | 20.00 | 20.00 |
| 1520 US* | 6.50 | 6.50 |
| Keltrol Rd** | 0.25 | 0.50 |
| Benzoic Acid | 0.05 | 0.05 |
| Sorbic Acid | 0.10 | 0.10 |
| Water, City | 73.10 | 72.85 |
| pH = 4.0 | | |
| Test conditions: 160° F., 6 psi. | | |
| Both samples are uniform light yellow, opaque | | |

| Dynamic Foam Test City Water | |
|---|---|
| Formulation 1 | 1 min = 1" U |
| | 5 min = 1¼ U |
| Formulation 2 | 1 min = ¾" U |
| | 5 min = 1¾ U |

*Silicone/silica defoamer

TABLE IX-continued

**Xanthan gum (Kelco)
U = unstable foam.

The data of Example 4 and Table IX show that the nonionic surfactant materials of the invention can be combined with thickeners, preservative stabilizing agents and silicone defoamers to form a uniform single phase compatible material. Such materials can be used to form aqueous rinses that can be used to rinse ware without the production of substantial foam.

Example 5

TABLE X

High Temperature Rinse Additive Sheeting Test

Product: Example 4
Tween 80 20%
Aldo MSD 10%
Conditions:
Champion 1KAB Machine
Water: Soft, 8 ppm
Key:
— No Sheeting
P Pinhole Sheeting
C Complete Sheeting

| PPM | TEMP | CHINA PLATE | MELAM PLATE | GLASS TUMB. | GLASS SLIDE | S.S. KNIFE | S.S. SLIDE | FOAM INCHES |
|---|---|---|---|---|---|---|---|---|
| 0 | 163° | — | — | — | — | — | — | — |
| 25 | 163° | — | — | — | — | — | — | — |
| 50 | 161° | C | C | C | — | C | C | — |
| 75 | 161° | C | C | C | C | C | C | Trace |
| 100 | 160° | C | C | C | C | C | C | Trace |

Example 5 and Table X show that the nonionic surfactant plus defoamer can be combined into a single phase stable rinse aid which then can be used in available automatic warewashing machines and can produce sheeting on all of a variety of surfaces common in ware washing including china, melamine plastic, glass and stainless steel tableware.

The foregoing examples and data demonstrate the sheeting capacity and low foam properties of the sorbitan fatty acid ester nonionic surfactant in rinse agent and aqueous rinse formulations. The tables data also show that the foaming nonionic sorbitan surfactant can be effectively defoamed using carefully selected defoaming agents. In particular, the tables show the utility of alkali metal fatty acid salts, glyceryl esters of fatty acid materials, and silicone-based defoamers in the rinse agent of the invention. The success of these materials in defoaming the nonionic surfactant is surprising. We also find surprising that only certain defoamers work and that the combination of these defoamers with certain high foaming sorbitan esters yield rinse aid formulations that provide sheeting at reasonably low levels with no foam under a variety of conditions (high foam machine, soft water).

While the above description, examples and data provides a basis for understanding the invention, the invention can be made in a variety of embodiments. The invention resides in the claims hereinafter appended.

We claim:

1. A food grade liquid rinse aid composition, suitable for dilution to form an aqueous rinse, the composition consisting essentially of:

(a) about 5 to 50 wt-% of a sorbitan fatty acid mono ester containing greater than about 15 moles of alkylene oxide per mole of sorbitan;

(b) about 0.2 to 25 wt-% of a defoamer composition selected from the group consisting of an alkali metal or alkaline earth metal salt of a fatty acid, a silicone, a fatty acid ester of glycerol, and mixtures thereof; and (c) about 10 to 95 wt-% of an aqueous diluent; wherein the rinse aid composition is formulated from the above components approved as food additives and displays adequate sheeting properties during a rinse cycle of mechanical warewashing, at a concentration of at least about 50 parts of the sorbitan fatty acid monoester per million parts of the rinse.

2. The composition of claim 1 wherein the defoamer comprises an alkali metal or alkaline earth metal salt of a fatty acid.

3. The composition of claim 2 wherein the defoamer comprises a sodium or potassium salt of a $C_8$–$C_{20}$ saturated or unsaturated fatty acid.

4. The composition of claim 1 wherein the silicone defoamer comprises a polydimethyl siloxane.

5. The composition of claim 4 wherein the defoamer comprises a combination of about 0.01 to 100 parts by weight of a polydimethyl siloxane having an average chain length of 200 to 250 units, per each part by weight of silica.

6. The composition of claim 1 wherein the defoamer comprises a $C_8$–$C_{24}$ fatty acid mono ester of glycerol.

7. The composition of claim 6 wherein the defoamer comprises glyceryl stearate.

8. The composition of claim 6 wherein the defoamer comprises glyceryl oleate.

9. An aqueous rinse comprising about 10–500 parts of the rinse aid of claim 1 per million parts of aqueous diluent.

10. A cast solid food grade rinse aid composition, suitable for dilution to form an aqueous rinse, the composition consisting essentially of:

(a) about 5 to 50 wt-% of a sorbitan fatty acid mono ester containing greater than about 15 moles of alkylene oxide per mole of sorbitan;

(b) about 0.2 to 25 wt-% of a defoamer composition selected from the group consisting of an alkali metal or alkaline earth metal salt of a fatty acid, a silicone, a fatty acid ester of glycerol, and mixtures thereof; and (c) about 10 to 95 wt-% of an aqueous diluent; wherein the rinse aid composition is formulated from the above components approved as food additives and displays adequate sheeting properties during a rinse cycle of mechanical warewashing, at a concentration of at least about 50 parts of the sorbitan fatty acid monoester per million parts of the rinse.

11. The composition of claim 10 wherein the defoamer comprises an alkali metal or alkaline earth metal salt of a fatty acid.

12. The composition of claim 11 wherein the defoamer comprises a sodium or potassium salt of a $C_8$–$C_{20}$ saturated or unsaturated fatty acid.

13. The composition of claim 10 wherein the silicone defoamer comprises a polydimethylsiloxane.

14. The composition of claim 13 wherein the defoamer comprises a combination of about 0.01 to 100 parts by weight of a polydimethylsiloxane having an average chain length of 200 to 250 units, per each part by weight of silica.

15. The composition of claim 10 wherein the defoamer comprises a $C_8$–$C_{24}$ fatty acid mono ester of glycerol.

16. The composition of claim 14 wherein the defoamer comprises glyceryl stearate.

17. The composition of claim 14 wherein the defoamer comprises glyceryl oleate.

18. An aqueous rinse comprising about 10–500 parts of the rinse aid of claim 10 per million parts of aqueous diluent.

19. The composition of claim 10 wherein the casting agent diluent comprises a non-surfactant polyethyleneglycol.

20. The composition of claim 1, wherein the sorbitan fatty acid mono ester is a mono laurate ester having about 20 moles of ethylene oxide per mole of sorbitan.

21. The composition of claim 1, wherein the sorbitan fatty acid mono ester is a monooleate ester having about 20 moles of ethylene oxide per mole of sorbitan.

22. The composition of claim 1, wherein the sorbitan fatty acid mono ester is a mono stearate ester having about 20 moles of ethylene oxide per mole of sorbitan.

23. The composition of claim 10, wherein the sorbitan fatty acid mono ester is a mono laurate ester having about 20 moles of ethylene oxide per mole of sorbitan.

24. The composition of claim 10, wherein the sorbitan fatty acid mono ester is a monooleate ester having about 20 moles of ethylene oxide per mole of sorbitan.

25. The composition of claim 10, wherein the sorbitan fatty acid mono ester is a mono stearate ester having about 20 moles of ethylene oxide per mole of sorbitan.

* * * * *